US005341769A

United States Patent [19]

Ueno et al.

[11] Patent Number: 5,341,769

[45] Date of Patent: Aug. 30, 1994

[54] VAPORIZER FOR LIQUEFIED NATURAL GAS

[75] Inventors: Koichi Ueno; Akio Tsukamoto, both of Takasago; Tamotsu Tori, Kobe; Hiroo Nishimura, Kobe; Keizo Konishi, Kobe; Fukuzo Harada, Takasago, all of Japan

[73] Assignee: Kabushiki Kaisha Kobe Seiko Sho, Kobe, Japan

[21] Appl. No.: 989,375

[22] Filed: Dec. 11, 1992

[30] Foreign Application Priority Data

Dec. 12, 1991 [JP] Japan ..... 3-329053

[51] Int. Cl.[5] ..... F22B 23/06

[52] U.S. Cl. ..... 122/367.3; 165/176

[58] Field of Search ..... 122/367.3; 165/175, 165/176

[56] References Cited

U.S. PATENT DOCUMENTS 3,897,754 8/1975 Jerde ..... 122/367.3

4,903,763 2/1990 Laveran et al. ..... 165/175

FOREIGN PATENT DOCUMENTS 0450906 10/1991 European Pat. Off. .

1053538 3/1959 Fed. Rep. of Germany .

2903079 8/1979 Fed. Rep. of Germany .

*Primary Examiner*—Edward G. Favors

*Attorney, Agent, or Firm*—Oblon, Spivak, McClelland, Maier & Neustadt

[57] ABSTRACT

A vaporizer for liquefied natural gas which prevents the heat exchanger tubes from being extremely cooled, without reducing the vaporizing efficiency. The vaporizer is characterized in that each of the heat exchanger tubes connecting the lower header and upper header contains a pipe for liquefied natural gas in a certain region from its end near the inlet, said pipe having on its outer surface fins which are in pressure contact with the inner surface of the heat exchanger tube, and the heat exchanger tube is in direct contact with the natural gas in its region near the outlet and beyond the region in which the pipe for liquefied natural gas lies.

4 Claims, 14 Drawing Sheets

VAPORIZER FOR LIQUEFIED NATURAL GAS

BACKGROUND OF THE INVENTION

1. Field of the Invention

The present invention relates to a vaporizer of open-rack type which is used to vaporize liquefied natural gas.

2. Description of the Prior Art

Among the known vaporizers for liquefied natural gas is the vaporizer of open-rack type as disclosed in Japanese Utility Model Laid-open No. 75388/1987.

An example of the vaporizer is shown in FIG. 12. It consists of a lower header 90 and an upper header 92. The lower header 90 extends in the direction perpendicular to the drawing and permits liquefied natural gas 91 to flow therein. The upper header 92 runs above and parallel to the lower header 90. The two headers 90 and 92 communicate with each other through a multiplicity of heat exchanger tubes 94. The heat exchanger tubes 94 are arranged in the axial direction of the lower header 90 (which is perpendicular to the drawing). Each of the heat exchanger tubes 94 is provided with a pair of fins (not shown) projecting in the axial direction of the lower header 90. Thus these heat exchanger tubes 94 form a heat transfer panel. Each of the heat exchanger tubes 94 is provided at its upper part with a seawater trough 96, so that seawater 98 (as a heating medium) flows along the surface of the heat exchanger tube 94. The heat of the seawater 98 vaporizes the liquefied natural gas, permitting it to rise through the heat exchanger tube 94. The vaporized natural gas is recovered through the upper header 92.

The above-mentioned apparatus poses a problem arising from the fact that the lower header 90 and the lower part of the heat exchanger tube 94 are in direct contact with liquefied natural gas and hence they are cooled to an extremely low temperature. The cooled surface frosts, forming an ice layer 99 (which functions as a heat insulating layer) as shown in FIG. 12 (right). The ice layer 99 prevents heat exchange, causing the lower part of the heat exchanger tube 94 to be kept at a still lower temperature. As the result, the temperature gradient in the heat exchanger tube 94 becomes similar to that in the liquefied natural gas flowing in it, as shown in FIG. 13.

Upon extreme cooling, the lower part of the heat exchanger tube 94 shrinks to such a great extent that even a slightest fluctuation in the distribution of seawater 98 changes the shrinkage of the individual heat exchanger tubes 94, which, in the worst case, causes local deformation of the heat exchanger tubes 94.

To cope with this situation, there was proposed an idea that each heat exchanger tube 94 is provided with a plurality of fins **94*a* so that it has an enlarged surface area for better heat transfer from seawater 98. A disadvantage of this idea is that the fins 94*a*** make the surface configuration of the heat exchanger tube complex and the complex surface configuration easily becomes barnacled. The removal of barnacles is very difficult. In addition, the complex surface configuration is inconvenient for metal spraying with highly heat-conductive Al-Zn.

Any attempt to accelerate heat exchange between liquefied natural gas and seawater by increasing the heat transfer coefficient of the heat exchanger tube 94 itself is not successful because the ice layer 99 (as an insulating layer) becomes thicker in proportion to increase in the heat transfer coefficient. Consequently, it is impossible to prevent the lower part of the heat exchanger tube 94 from getting cooler. In addition, increasing the flow rate of both liquefied natural gas and seawater ends up with the thickening of the ice layer 99 because the increase in heat transfer coefficient by the increased flow rate of liquefied natural gas outweighs that by the increased flow rate of seawater.

The present invention was completed in view of the foregoing. Accordingly, it is an object of the present invention to provide a vaporizer for liquefied natural gas which prevents the heat exchanger tubes from being extremely cooled, without reducing the vaporizing efficiency.

SUMMARY OF THE INVENTION

The first aspect of the present invention resides in a vaporizer for liquefied natural gas having an inlet header into which liquefied natural gas is introduced and an outlet header into which vaporized natural gas is introduced, said inlet header and outlet header being connected to each other by heat exchanger tubes extending in the direction approximately perpendicular to said inlet header and outlet header, each of said heat exchanger tubes being heated by a heating medium running along the outside thereof so that liquefied natural gas is vaporized therein, characterized in that said heat exchanger tube is provided therein with a pipe through which liquefied natural gas is introduced into said inlet header, said pipe extending from one end thereof near said inlet header to a certain position, said pipe having fins projecting from the outside thereof toward the inside of said heat exchanger tube, with the ends of said fins being in pressure contact with the inside of said heat exchanger tube, so that that part of said heat exchanger tube which is near the outlet header and beyond the region in which said pipe lies is in direct contact with liquefied natural gas.

According to the second aspect of the present invention, said fins are bent midway in the direction perpendicular to their projecting direction and the forward end of the fin is pressed against the inside of the heat exchanger tube, with the bent part deformed.

According to the third aspect of the present invention, the heat exchanger tube has, in the part thereof which is near the outlet header and beyond the region in which said pipe lies, a guide member to guide liquefied natural gas passing therethrough to the inside wall thereof.

According to the fourth aspect of the present invention, the heat exchanger tube has, in the part thereof which is near the outlet header and beyond the region in which said pipe lies, a heat transfer member which is in contact with both the liquefied natural gas passing through the heat exchanger tube and the inside wall of the heat exchanger tube.

The third and fourth aspects of the present invention produce the pronounced effects mentioned below.

BRIEF DESCRIPTION OF THE DRAWINGS

FIG. 10(*b*) is a sectional plan view showing the same apparatus as in FIG. 10(*a*) in which the space between the pipe for liquefied natural gas and the heat exchanger tube is filled with a filler.

FIG. 11(*b*) is a sectional plan view showing a modified embodiment of the vaporizer for liquefied natural gas in which the heat exchanger tube has fins on the inner surface thereof.

DETAILED DESCRIPTION OF THE INVENTION

Figure 1:
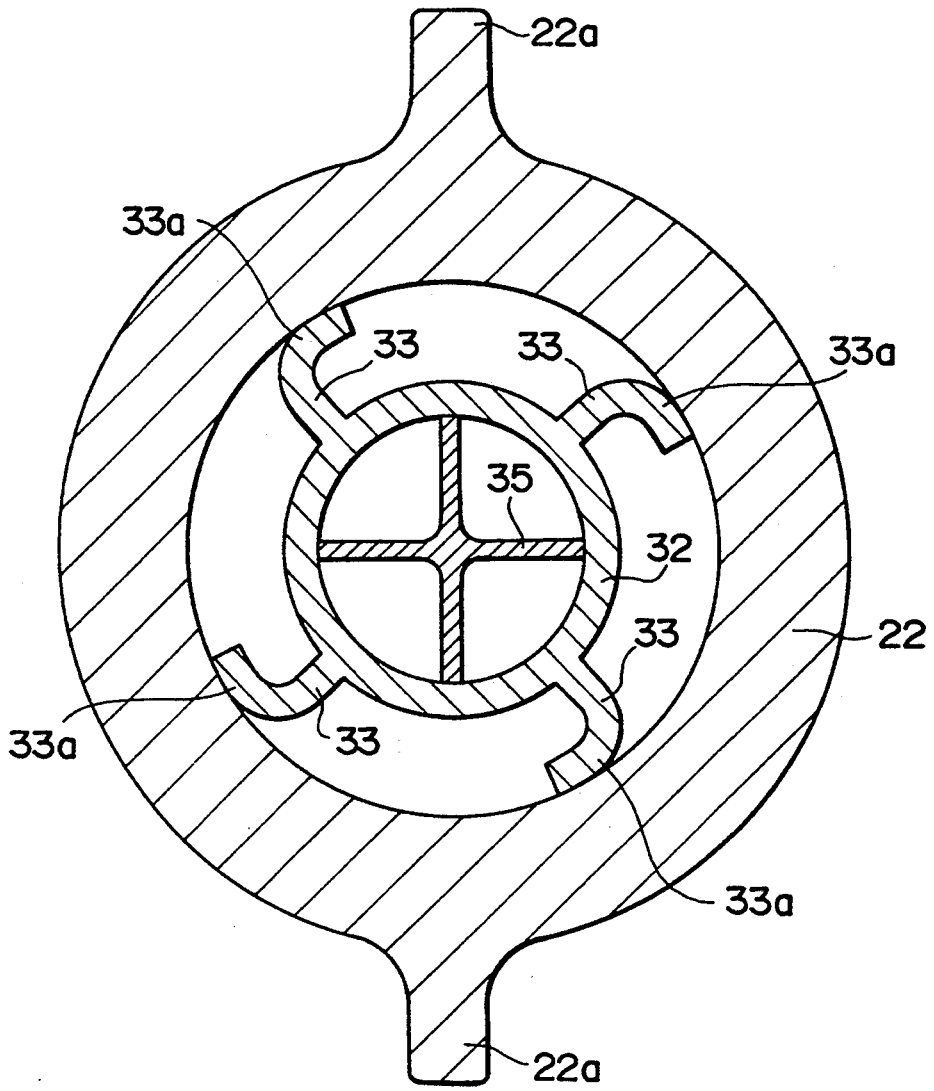
FIG. 1 is a sectional view taken along the line I—I of FIG. 3.

The vaporizer as defined in the first aspect of the present invention offers an advantage that a heat insulating layer is formed between the heat exchanger tube and the pipe for liquefied natural gas, because the heat exchanger tube is provided with a pipe through which liquefied natural gas passes in that part thereof which is near the inlet header or in the low-temperature part thereof. The heat insulating layer has a low heat transfer coefficient and hence reduces heat transfer from liquefied natural gas to the heat exchanger tube. This permits the heat exchanger tube to remain at a comparatively high temperature and hence prevents the heat exchanger tube from shrinking excessively.

Although the heat insulating layer reduces heat exchange between the heating medium and liquefied natural gas, the vaporizer of the present invention is by no means inferior to the conventional one in efficiency, because, if it were not for the heat insulating layer, the heat exchanger tube is cooled more than necessary and hence covered with ice which functions as an insulating layer to eventually prevent the heat exchange required. In addition, the fact that the pipe for liquefied natural gas is in contact with the heat exchanger tube through fins makes it possible to control the amount of heat which transfers from liquefied natural gas to the heat exchanger tube, if the area of the fins in contact with the inside wall of the heat exchanger tube (or the outside wall of the pipe for liquefied natural gas) is properly adjusted. Moreover, the fact that the fins are in mere pressure contact with the inside wall of the heat exchanger tube (or the outside wall of the pipe for liquefied natural gas) but are not completely joined and fixed to it protects the pipe for liquefied natural gas from thermal stress even though it shrinks due to cooling.

The second aspect of the present invention offers an advantage of keeping the fins in pressure contact with the inside wall of the heat exchanger tube (or the outside wall of the pipe for liquefied natural gas) even though they shrink due to cooling. This is because each fin is bent midway such that the bent part thereof is pressed against the inside wall of the heat exchanger tube (or the outside wall of the pipe for liquefied natural gas) by its elastic deformation. This structure makes it easy to control the area of contact (or the heat transfer area of the fin) by adjusting the length of the bent part of the fin.

The third and fourth aspects of the present invention offer an advantage that heat exchange between the heat exchanger tube and liquefied natural gas is promoted by a guide member or a heat transfer member, which is in that part of the heat exchanger tube which is near the outlet header and beyond the region in which the pipe for liquefied natural gas lies. The guide member guides liquefied natural gas to the inside wall of the heat exchanger tube. The heat transfer member is in contact with both the liquefied natural gas and the inside wall of the heat exchanger tube so that it promotes heat exchange between them.

EXAMPLES

Figure 2:
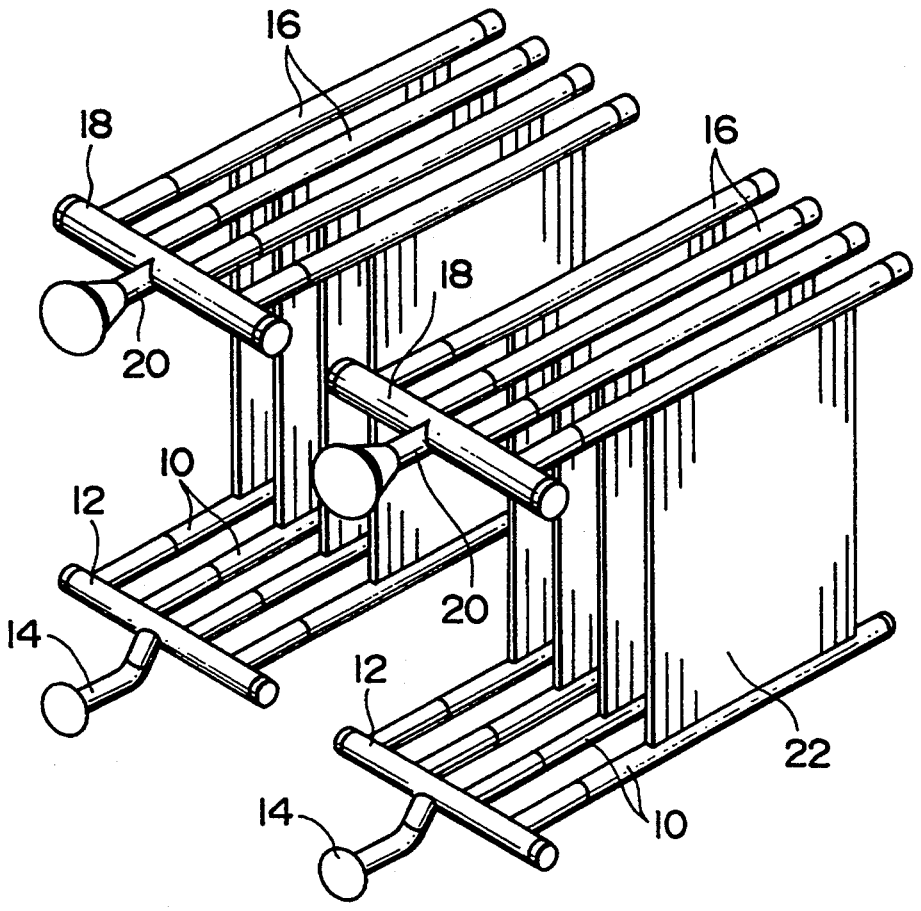
FIG. 2 is a general perspective view of the vaporizer for liquefied natural gas pertaining to the first embodiment of the present invention.

FIG. 2 is a general perspective view showing the vaporizer for liquefied natural gas pertaining to the first embodiment of the present invention.

This apparatus has a plurality of lower headers (inlet headers) 10 which are arranged horizontally and grouped for connection to a manifold 12. This apparatus also has a plurality of upper headers 16 which are arranged parallel to the respective lower headers 10 and grouped for connection to a manifold 18. Liquefied natural gas is introduced into the lower headers 10 through the inlet 14 and the manifold 12. The paired upper header 16 and lower header 10 communicate with each other through a plurality of heat exchanger tubes 22 which form a heat transfer panel.

Figure 3:
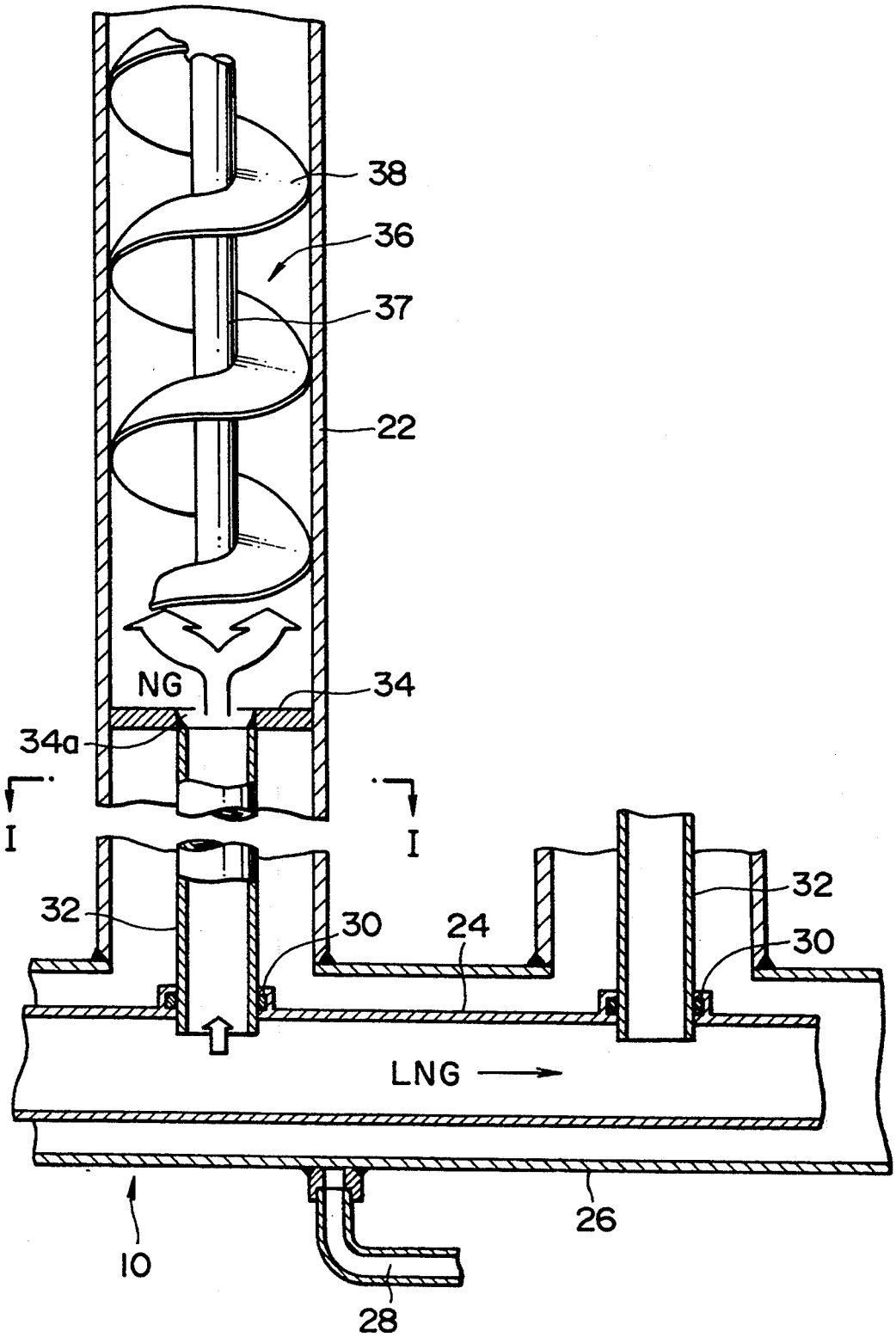
FIG. 3 is a sectional front view showing important parts of the above-mentioned vaporizer for liquefied natural gas.

The lower header 10 is of double-layer structure, made up of an inner pipe 24 and an outer pipe 26, as shown in FIG. 3. The inner pipe 24 has holes (not shown) at proper intervals, so that the vapor of liquefied natural gas escapes from the inner pipe 24 and fills the outer pipe 26.

Incidentally, in FIG. 3, there is shown a drain pipe 28 connected to the bottom of the outer pipe 26.

Figure 12:
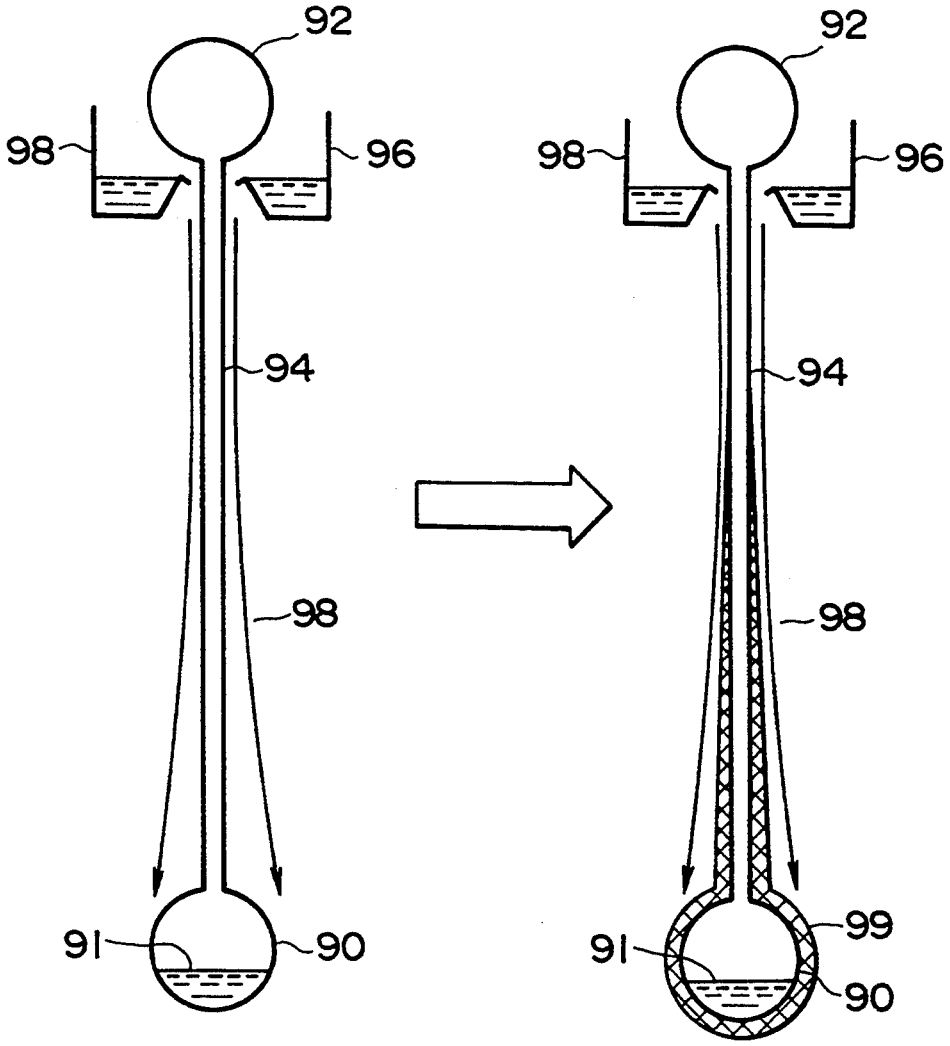
FIG. 12 PRIOR ART
FIG. 12 is a schematic sectional front view illustrating how ice layers are formed in the conventional vaporizer for liquefied natural gas.
Figure 13:
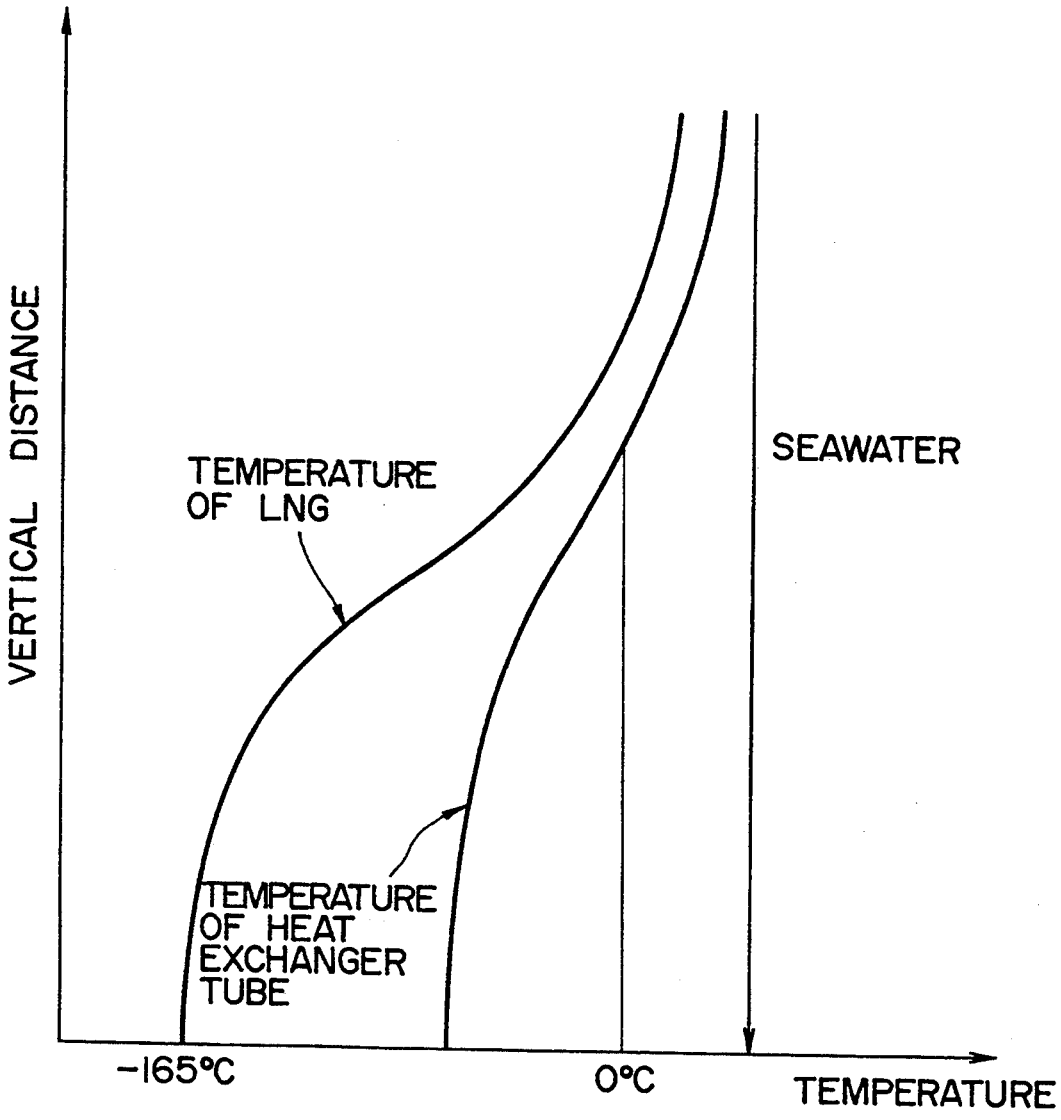
FIG. 13 PRIOR ART
FIG. 13 is a graph showing the relationship between the temperature of liquefied natural gas and the vertical distance from the bottom of the heat exchanger tube.
Figure 14:
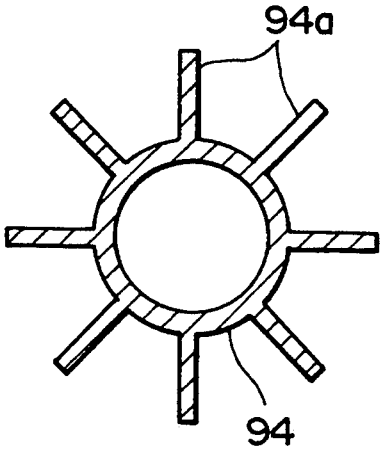
FIG. 14 PRIOR ART
FIG. 14 is a sectional plan view showing a modified embodiment of the above-mentioned vaporizer for liquefied natural gas in which the heat exchanger tube has fins.

As shown in section in FIG. 1, the heat exchanger tube 22 has on the outside thereof a pair of fins 22*a* extending in the axial direction thereof. These fins 22*a* promote heat exchange with seawater flowing along them as shown in FIG. 12. Upon heat exchange with seawater, the liquefied natural gas vaporizes and the vaporized natural gas is recovered through the heat exchanger tubes 22 and the upper header 16.

This apparatus (vaporizer) is characterized in that the heat exchanger tube 22 contains a pipe 32 for liquefied natural gas. This pipe 32 extends from the lower end (near the inlet header) of the heat exchanger tube to a certain height. The pipe 32 for liquefied natural gas is connected to the inner pipe 24, with a sealing member 30 placed between them, as shown in FIG. 3, so that liquefied natural gas is introduced only into the pipe 32 for liquefied natural gas.

The pipe 32 for liquefied natural gas extends over a certain region which is established properly for the individual apparatus. This region usually coincides with the region in which liquefied natural gas partly vaporizes to such an extent that an extreme temperature decrease occurs due to the latent heat of evaporation of liquefied natural gas.

The pipe 32 for liquefied natural gas has on the outside thereof four fins 33 which run in the axial direction (perpendicular to the drawing) and project in the radial direction, as shown in FIG. 1. Each of the fins 33 is bent midway in the direction (or the circumferential direction) perpendicular to the radial direction. The bent part is subject to elastic deformation which increases bending, such that the side of the forward end 33*a* of the fin 33 is in pressure contact with the inside wall of the heat exchanger tube 22. Moreover, the pipe 32 for liquefied natural gas contains a twist bar 35 having a cross-shaped section which promotes heat exchange between liquefied natural gas and the pipe 32 for liquefied natural gas.

The above-mentioned structure may be formed by drawing the twist bar 35 and the pipe 32 for liquefied natural gas together, with the former as a core, and then drawing the pipe 32 and the heat exchanger tube 22 together, with the former as a core.

The pipe 32 for liquefied natural gas, the fin 33, and the twist bar 35 should preferably be made of aluminum, which is superior in workability and heat conductivity, as in the case of heat exchanger tube 22. Alternatively, the heat exchanger tube 22 may be made of titanium, which is superior in corrosion resistance, and the pipe 32 for liquefied natural gas may be made of aluminum, which is less expensive than titanium. Using these two materials contributes to improved corrosion resistance as well as low equipment cost.

The heat exchanger tube 22 contains an annular partition plate 34 which is fixed at the position corresponding to the upper end of the pipe 32 for liquefied natural gas, as shown in FIG. 3. The annular partition plate 34 has a through hole 34*a* at the center thereof. To the periphery of the through hole 34*a* is connected the upper end of the pipe 32 for liquefied natural gas. The partition wall 34 closes the space between the pipe 32 for liquefied natural gas and the heat exchanger tube 22. Because of this structure, the pipe 32 for liquefied natural gas permits liquefied natural gas to flow through it and the space between the pipe 32 for liquefied natural gas and the heat exchanger tube 22 is filled with natural gas at a low temperature which functions as an insulating layer. Therefore, heat exchange between the pipe 32 for liquefied natural gas and the heat exchanger tube 22 takes place through the fins 33.

The heat exchanger tube 22 also contains a spiral member 36 (as a guide member and a heat transfer member), which is fixed above the partition plate 34. This spiral member 36 is made of a heat-conducting material as in the case of the heat exchanger tube 22, the pipe 32 for liquefied natural gas, and the fins 33. The spiral member 36 is made up of an axis 37 (extending in the same direction as the heat exchanger tube 22) and a spiral blade 38. The periphery of the spiral blade 38 is in contact with the inside wall of the heat exchanger tube 22.

This structure may be formed by drawing the spiral member 36 and the heat exchanger tube 22 together, with the former as a core.

The apparatus (vaporizer) mentioned above functions in the following manner.

First, liquefied natural gas enters the inner pipe 24 of the lower header 10. Then, it flows into the pipe 32 in the heat exchanger tube 22. It undergoes heat exchange with seawater running along the outside of the heat exchanger tube 22, thereby vaporizing and getting warm. Vaporized natural gas is recovered through the upper header 16.

It should be noted that liquefied natural gas enters the pipe 32 at the lower part of the heat exchanger tube 22 (or the low-temperature part). In other words, liquefied natural gas does not come into direct contact with the heat exchanger tube 22 owing to the insulating layer formed between the pipe 32 and the heat exchanger tube 22. This prevents the outer surface of the heat exchanger tube 22 from becoming extremely cold and hence prevents it from icing. It follows, therefore, that the shrinkage of the heat exchanger tube 22 at the low-temperature part is reduced and made uniform.

At first sight, the dual-pipe structure seems to prevent heat exchange between liquefied natural gas and seawater and hence reduce the efficiency of vaporization of liquefied natural gas accordingly. This does not happen in actuality. If liquefied natural gas comes into direct contact with the heat exchanger tube, an insulating layer of ice is formed on the outer surface of the heat exchanger tube 22, as shown in FIG. 12. Thus, the overall efficiency is not impaired by the dual-pipe structure.

The vaporized natural gas, which has left the pipe 32 for liquefied natural gas, subsequently enters the upper part of the heat exchanger tube 22 in which natural gas is vaporized almost completely. In this part, the vaporized natural gas flows along the spiral blade 38 which positively guides the vaporized natural gas toward the inside wall of the heat exchanger tube 22. In addition, the spiral member 36 itself functions as a heat conducting medium between the natural gas and the heat exchanger tube 22. This arrangement promotes heat exchange between the natural gas and the heat exchanger tube 22 and hence heats the natural gas efficiently.

According to this embodiment, the vaporizer is characterized in that the lower part of the heat exchanger tube 22 is of dual-pipe structure. This structure prevents the surface of the heat exchanger tube 22 from icing and also prevents the great shrinkage of the heat exchanger tube 22, without any appreciable loss of the efficiency of vaporization of liquefied natural gas. The vaporizer is also characterized in that the heat exchanger tube 22 contains in its upper part the spiral member 36 which promotes heat exchange between the natural gas and the heat exchanger tube 22, thereby promoting the heating of the natural gas.

In addition, this embodiment offers another advantage. That is, the pipe 32 for liquefied natural gas is provided with the fins 33 projecting from the outer surface thereof. Each of the fins 33 is bent midway, with the bent part elastically deformed and the side of the forward end 33*a* thereof pressed against the inside wall of the heat exchanger tube 22. This structure makes it easy to control the area of heat transfer between the fin 33 and the heat exchanger tube 22, by properly adjusting the length of the forward end 33*a*. The fact that the fin 33 and the heat exchanger tube 22 are separate from each other offers an advantage that the slight deformation of the fin 33 by shrinkage induces very little stress and the elastic deformation of the bent part of the fin 33 ensures the pressure contact between the fin 22 and the heat exchanger tube 22. This is not the case if the fin 33 is firmly fixed to the heat exchanger tube 22, in which case the shrinkage of the fin 33 induces a great stress.

Figure 4:
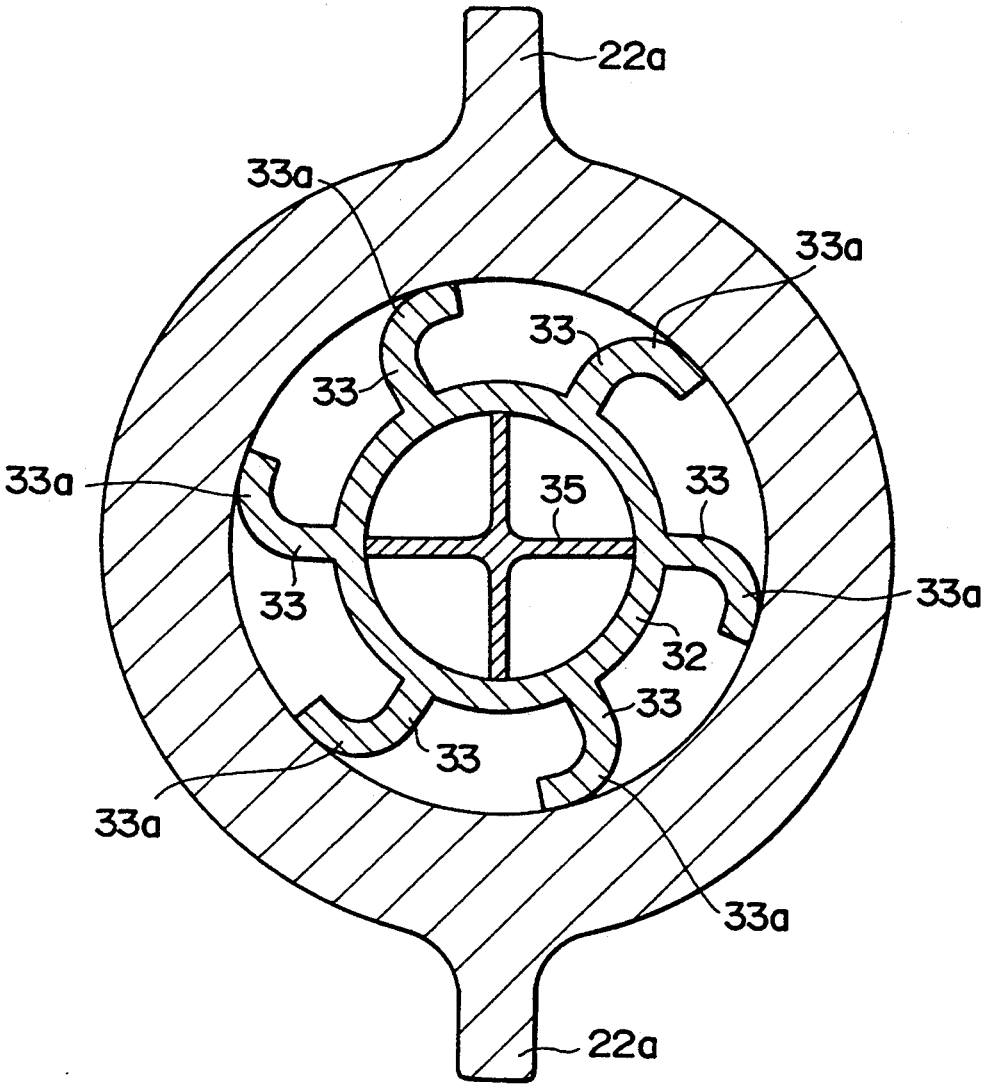
FIG. 4 is a sectional plan view of a modified embodiment of the above-mentioned vaporizer for liquefied natural gas in which the pipe for liquefied natural gas has an increased number of fins.

According to the present invention, the number of the fins 33 is not specifically limited but may be established for individual units. An example of the pipe having 6 fins is shown in FIG. 4.

According to the present invention, it is not always necessary that the heat exchanger tube 22 have the fins 22*a* on its outer surface and the pipe 32 for liquefied natural gas contain the twist bar 35. They may be formed as required.

Figure 5:
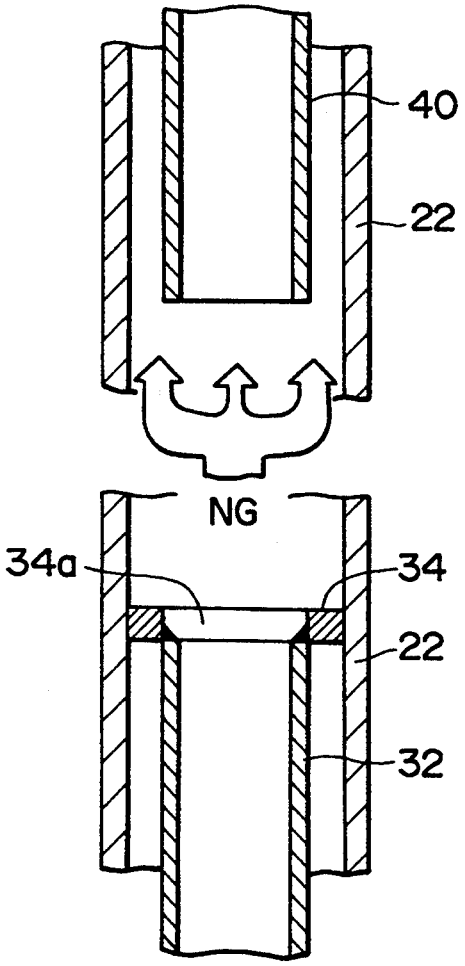
FIG. 5 is a sectional front view showing important parts of the vaporizer for liquefied natural gas pertaining to the second embodiment of the present invention.
Figure 6:
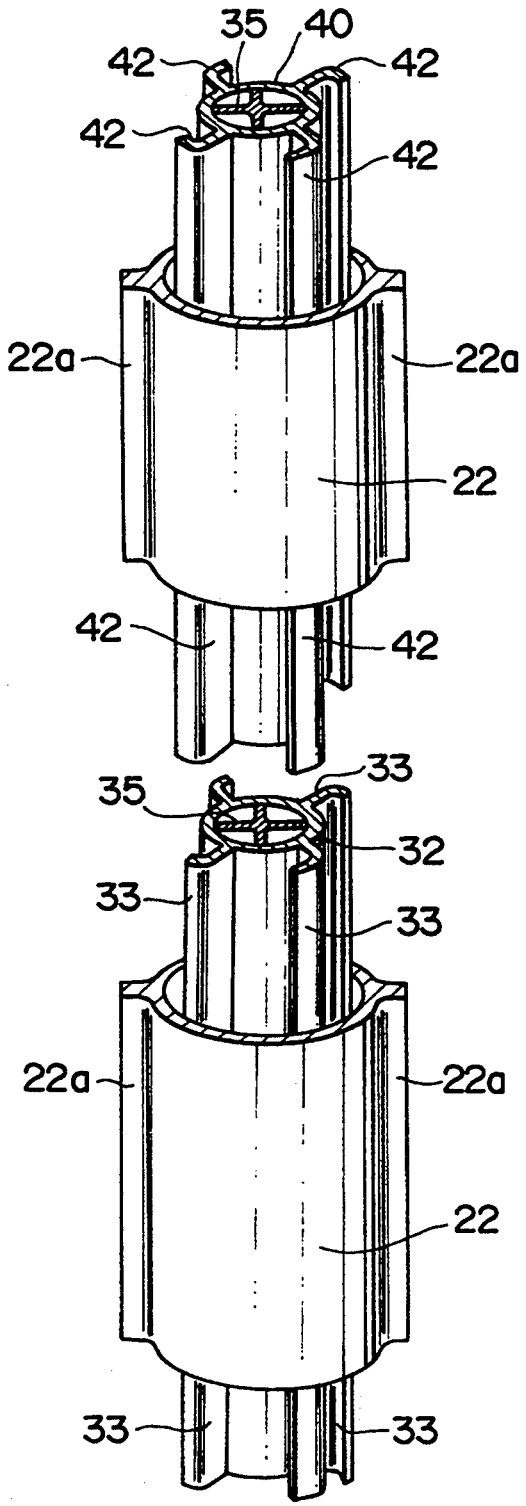
FIG. 6 is a partly cutaway perspective view showing important parts of the above-mentioned vaporizer for liquefied natural gas.
Figure 7:
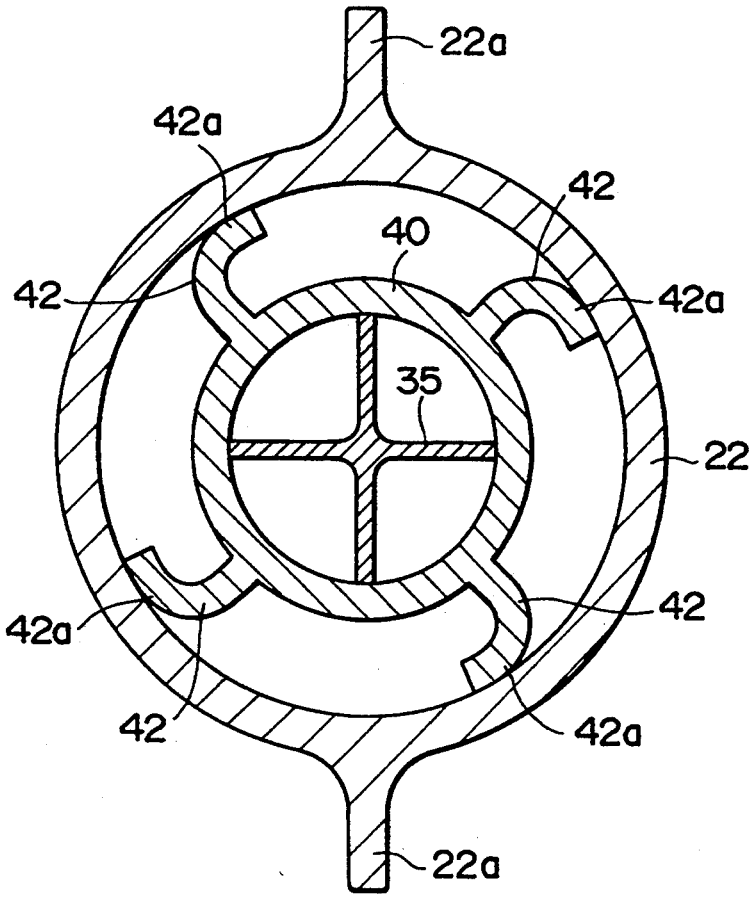
FIG. 7 is a sectional plan view showing the internal structure of the upper part of the heat exchanger tube in the above-mentioned vaporizer for liquefied natural gas.

The second embodiment of the present invention will be described with reference to FIGS. 5 to 7.

This embodiment is characterized in that the heat exchanger tube 22 contains in its upper part an inner pipe (heat transfer member) 40 in place of the above-mentioned spiral member 36. The inner pipe 40 is of the same shape as the above-mentioned pipe 32 for liquefied natural gas. Thus, the inner pipe 40 contains the twist bar 35 as shown in FIGS. 6 and 7. The inner pipe 40 also has on its outer surface four fins 42 projecting outward in the radial direction and bending midway, such that the side of the forward end 42*a* is in pressure contact with the inside wall of the heat exchanger tube 22. The inner pipe 40 has open upper and lower ends, as shown in FIG. 5, so that the natural gas flows upward through both the inner pipe 40 and the space between the inner pipe 40 and the heat exchanger tube 22.

Figure 8:
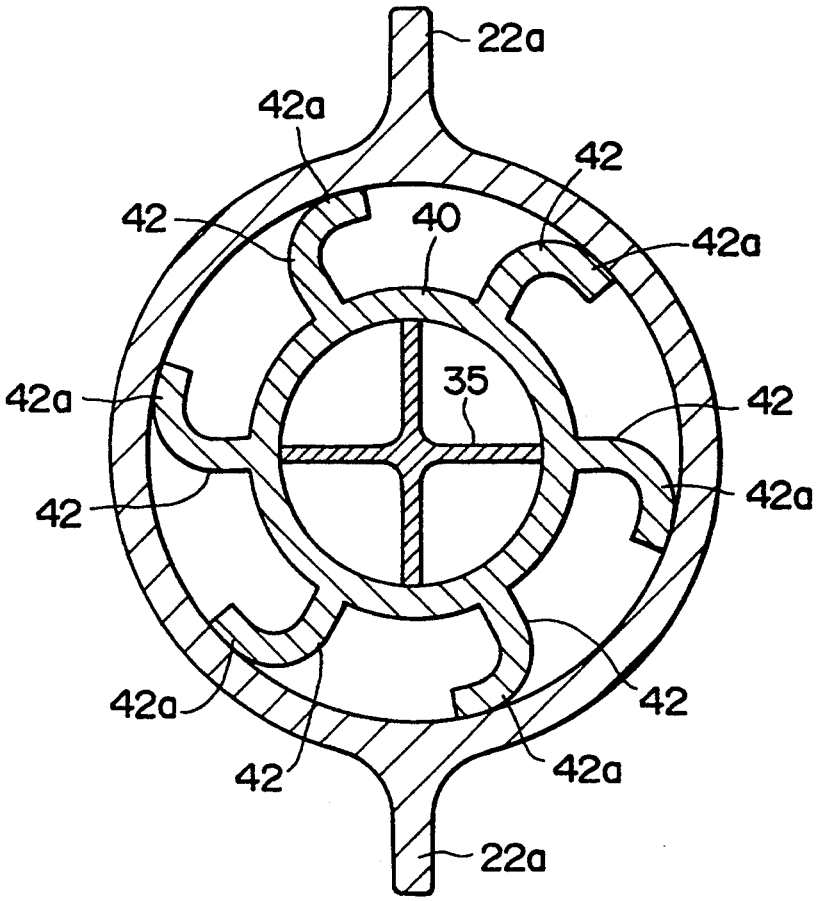
FIG. 8 is a sectional plan view of a modified embodiment of the above-mentioned vaporizer for liquefied natural gas in which the inner pipe positioned in the upper part of the heat exchanger tube has an increased number of fins on its outer surface.

This structure helps the natural gas to get warm easily because the natural gas flowing through the space between the inner pipe 40 and the heat exchanger tube 22 undergoes heat exchange directly with the heat exchanger tube 22 with the help of the fins 42. The number of the fins 42 is not specifically limited. An example of the inner pipe 40 having 6 fins is shown in FIG. 8.

Figure 9:
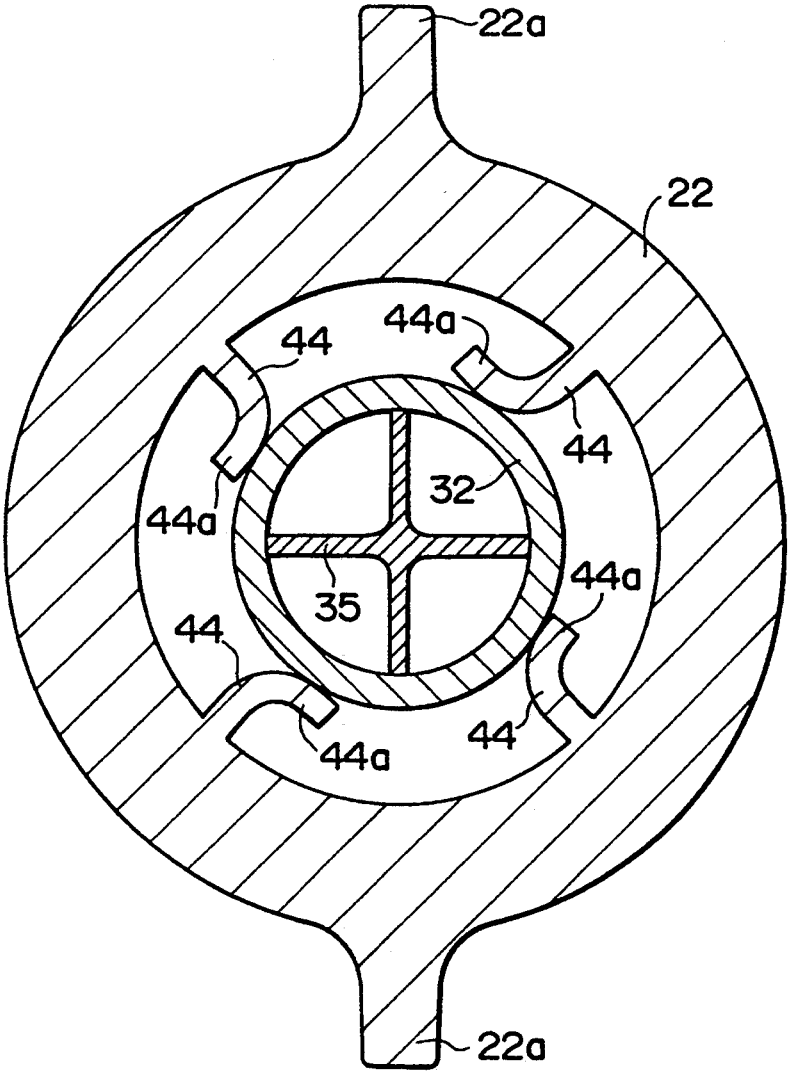
FIG. 9 is a sectional plan view showing important parts of the vaporizer for liquefied natural gas pertaining to the third embodiment of the present invention.

The third embodiment of the present invention is shown in FIG. 9. This embodiment is characterized in that the heat exchanger tube 22 has on its inner surface the fins 44 projecting inward in the radial direction. (Compare with the first embodiment in which the pipe 32 for liquefied natural gas has on its outer surface the fins 33 projecting outward.) In this case, too, the fins 44 are bent midway in the direction approximately perpendicular to the projecting direction, and the side of the forward end 44*a* of the fin 44 is in pressure contact with the outer surface of the pipe 32 for liquefied natural gas. This structure produces the same effect as in the first embodiment.

Figure 10A:
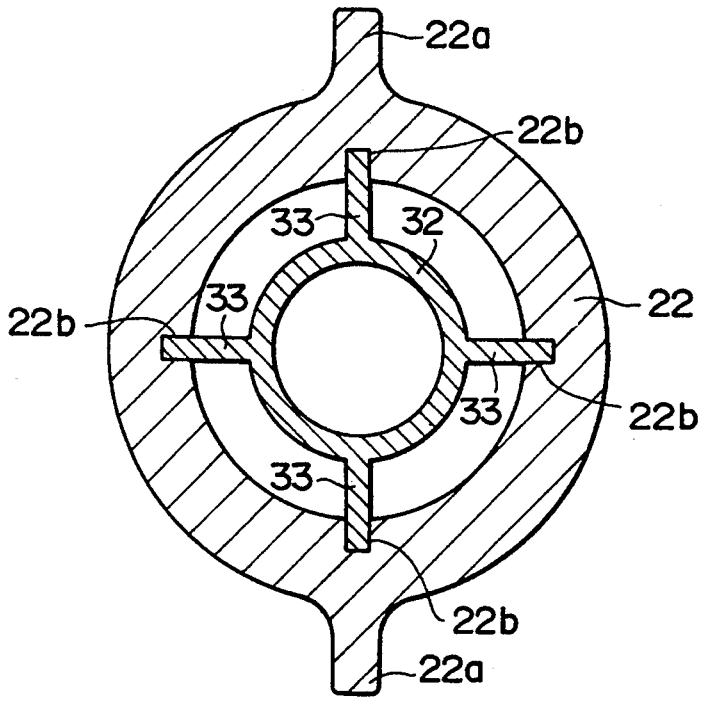
FIG. 10 (*a*) is a sectional plan view showing important parts of the vaporizer for liquefied natural gas pertaining to the fourth embodiment of the present invention.
Figure 10B:
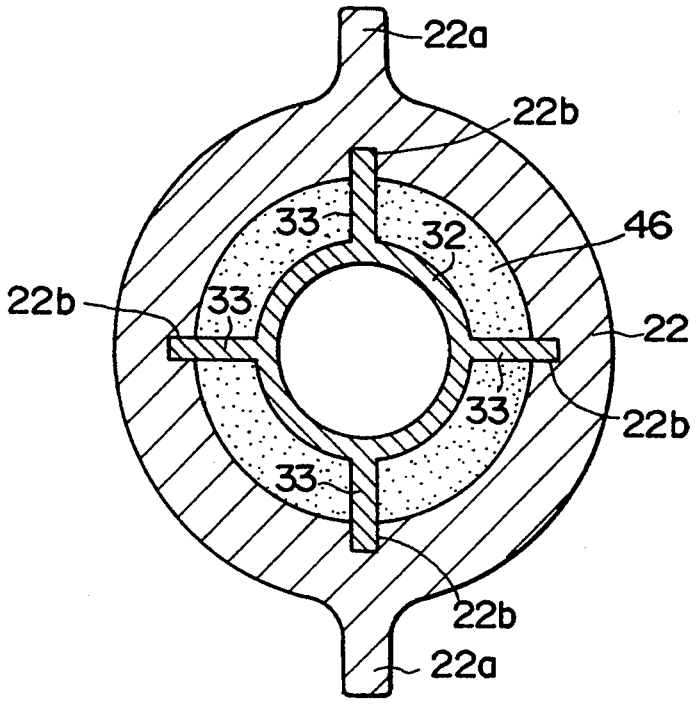

The fourth embodiment of the present invention is shown in FIG. 10(*a*). In this embodiment, the pipe 32 for liquefied natural gas has fins 33 projecting straight outward in the radial direction, with the forward end thereof press fitted into a groove 22*a* formed in the inside wall of the heat exchanger tube 22, said groove being slightly narrower than the thickness of the fin 33. The fact that the fin 33 and the heat exchanger tube 22 are separate from each other offers an advantage that the shrinkage of the pipe 32 and fins 33 induce very little stress. This structure may be modified such that the fins 33 (or 44) are bent midway and the side of the forward end 33*a* (or 44*a*) of the bent part is pressed against the opposing surface, so as to ensure the pressure contact between the fin 33 (or 44) and the opposing surface by the aid of the resilience of the bent part. In addition, this structure makes it easy to control the area of their contact.

Figure 11A:
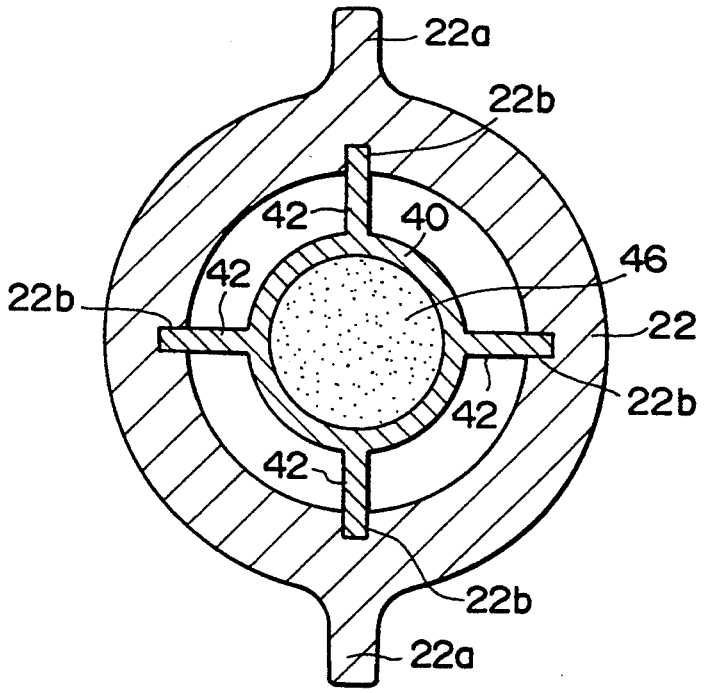
FIG. 11(*a*) is a sectional plan view showing a modified embodiment of the vaporizer for liquefied natural gas in which the inner pipe in the upper part of the heat exchanger tube is filled with a filler.
Figure 11B:
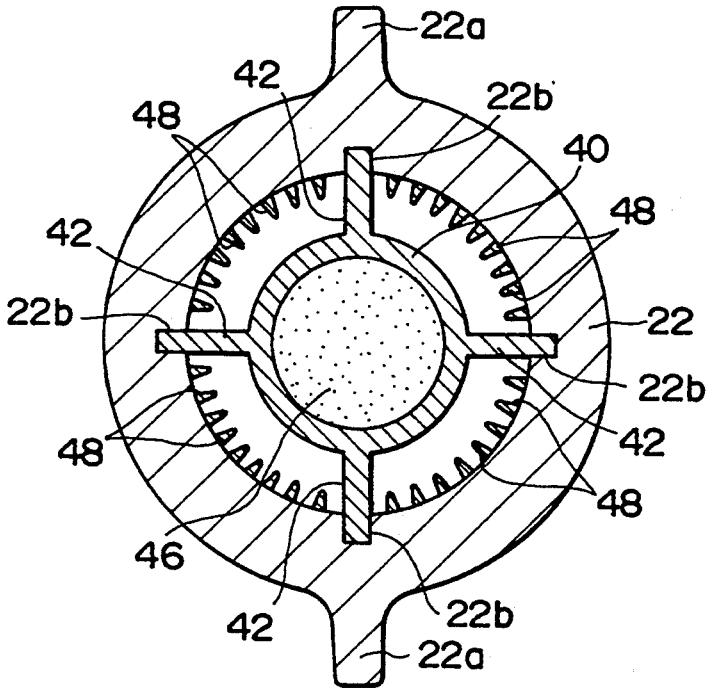

The present invention is not limited to the specific embodiments mentioned above; they may be changed and modified as follows:

(1) The apparatus shown above is constructed such that the heat exchanger tube 22 contains the pipe 32 for liquefied natural gas, with the space between them left hollow. In a modified embodiment, this hollow space may be filled with a filler 46 (insulating material) as shown in FIG. 10(*b*). The embodiment in which the heat exchanger tube 22 contains the inner pipe 40 in its upper part may be modified such that the inner pipe 40 is filled with a filler 46, as shown in FIG. 11(*a*), so that the natural gas flows only through the space between the inner pipe 40 and the heat exchanger tube 22. This arrangement positively guides the natural gas to the heat exchanger tube 22. Alternatively, the inner surface of the heat exchanger tube 22 may be provided with a large number of fins 48, as shown in FIG. 10(*b*), so as to increase the surface area thereof.

(2) The idea of the present invention may be applied to any apparatus in which the upper header functions as an inlet and the lower header functions as an outlet (in other words, liquefied natural gas flows through the heat exchanger tube 22 in the opposite direction).

(3) The structure of the lower header 10 is not limited to the dual-pipe structure mentioned above. The ordinary single-pipe structure may suffice.

(4) According to the present invention, the partition plate 34 is positioned at the upper end of the pipe 32 for liquefied natural gas. However, it may be positioned at the lower end of the pipe 32 for liquefied natural gas.

(5) According to the present invention, the size of the pipe for liquefied natural gas should be properly selected so that an adequate space is formed between the pipe and the heat exchanger tube and the fins should be properly formed so that they provide an adequate area of contact with the inner surface of the heat exchanger tube (or the outer surface of the pipe for liquefied natural gas). Their adequate values should be established by taking into account the estimated heat insulating effect of the ice layer which would occur if it were not for the heat insulating part mentioned above.

Effect of the Invention

As mentioned above, the present invention provides a vaporizer for liquefied natural gas which is characterized in that the heat exchanger tube contains a pipe for liquefied natural gas in a specific region from its end near the inlet, the pipe for liquefied natural gas has fins on the outer surface thereof (or the heat exchanger tube has fins on the inner surface thereof), with the fins pressed against the opposing surface, and the heat exchanger tube contains (in the region above the pipe for liquefied natural gas) a means which brings the natural gas into direct contact with the heat exchanger tube. This structure prevents the outer surface of the heat exchanger tube (especially near the inlet) from being extremely cooled, without reducing the vaporizing efficiency, with the result that it is possible to prevent the heat exchange tube from deforming due to uneven shrinkage. Moreover, the fins are in pressure contact with the outer surface of liquefied natural gas or with the inner surface of the heat exchanger tube. The structure prevents stress from occurring when the pipe for liquefied gas and the fins shrink. The fins offer an advantage that it is possible to control the amount of heat transfer from the liquefied natural gas flowing through the pipe for liquefied natural gas to the heat exchanger tube, by establishing an adequate area of pressure contact.

The apparatus (vaporizer) pertaining to the second aspect of the present invention is characterized in that each of the fins is bent midway and the side of the forward end of the fin is pressed against the outer surface of the pipe for liquefied natural gas or the inner surface of the heat exchanger tube. This structure permits the fin to be in pressure contact with the opposing surface by the aid of resiliency arising from the elastic deformation of the bent part. In addition, this structure offers an advantage that it is possible to easily control the contact area of the fin by establishing an adequate length of the bent part.

The apparatus (vaporizer) pertaining to the third or fourth aspect of the present invention is characterized in that the heat exchanger tube contains a guide member which directs natural gas to the inner surface of the heat exchanger tube or the heat exchanger tube contains a heat conducting member which promotes heat exchange between natural gas and the inner surface of the heat exchanger tube.

What is claimed is:

1. A vaporizer for liquefied natural gas having an inlet header into which liquefied natural gas is introduced and an outlet header into which vaporized natural gas is introduced, said inlet header and outlet header being connected to each other by heat exchanger tubes extending in the direction approximately perpendicular to said inlet header and outlet header, each of said heat exchanger tubes being heated by a heating medium running along the outside thereof so that liquefied natural gas is vaporized therein, characterized in that said heat exchanger tube is provided therein with a pipe through which liquefied natural gas is introduced from said inlet header, said pipe extending from one end thereof near said inlet header to a certain position, said pipe having fins projecting from the outside thereof toward the inside of said heat exchanger tube, with the ends of said fins being in pressure contact with the inside of said heat exchanger tube, so that that part of said heat exchanger tube which is near the outlet header and beyond the region in which said pipe lies is in direct contact with liquefied natural gas.

2. A vaporizer for liquefied natural gas as defined in claim 1, wherein said fins are bent midway in the direction perpendicular to their projecting direction and the forward end of the fin is pressed against the inside of the heat exchanger tube, with the bent part deformed.

3. A vaporizer for liquefied natural gas as defined in any of claims 1 and 2, wherein the heat exchanger tube has, in the part thereof which is near the outlet header and beyond the region in which said pipe lies, a guide member to guide liquefied natural gas passing therethrough to the inside wall thereof.

4. A vaporizer for liquefied natural gas as defined in any of claims 1 and 2, wherein the heat exchanger tube has, in the part thereof which is near the outlet header and beyond the region in which said pipe lies, a heat transfer member which is in contact with both the liquefied natural gas passing through the heat exchanger tube and the inside wall of the heat exchanger tube.

* * * * *